US005516483A

United States Patent [19]

Shivanath et al.

[11] Patent Number: 5,516,483

[45] Date of Patent: May 14, 1996

[54] HI-DENSITY SINTERED ALLOY

[75] Inventors: Rohith Shivanath; Peter Jones; Danny T. D. Thieu, all of Toronto, Canada

[73] Assignee: Stackpole Limited, Mississauga, Canada

[21] Appl. No.: 193,578

[22] Filed: Feb. 8, 1994

[51] Int. Cl.[6] ..... B22F 3/00

[52] U.S. Cl. ..... 419/14; 419/11; 419/12; 419/23; 419/25; 419/29; 419/39; 419/53; 419/58; 419/60; 419/8; 419/37

[58] Field of Search ..... 419/11, 12, 14, 419/23, 25, 26, 29, 39, 53, 58, 60, 8, 37; 148/545, 326; 75/238, 200

[56] References Cited

U.S. PATENT DOCUMENTS

| | | | |
|---|---|---|---|
| 4,251,273 | 2/1981 | Smith et al. | 75/200 |
| 4,524,046 | 6/1985 | Suganuma et al. | 419/8 |
| 4,885,133 | 12/1989 | Fujii | 419/29 |
| 4,891,080 | 1/1990 | Del Corso et al. | 148/326 |
| 4,966,626 | 10/1990 | Fujiki et al. | 75/238 |
| 5,139,579 | 8/1992 | Kovacs et al. | 148/545 |
| 5,154,881 | 10/1992 | Rutz et al. | 419/37 |

*Primary Examiner*—Donald P. Walsh
*Assistant Examiner*—John N. Greaves
*Attorney, Agent, or Firm*—Eugene J. A. Gierczak

[57] ABSTRACT

A process of forming a sintered article for powder metal comprising blending carbon and ferro alloys and lubricant with compressible elemental iron powder, pressing said blended mixture to form sintering said article, and then high temperature sintering said article in a reducing atmosphere to produce a sintered article having a high density from a single compression.

17 Claims, 9 Drawing Sheets

Controlling Technologies: High Density processing

UHCS High Density Powder Metal Process Stages - Schematic Diagram

HI-DENSITY SINTERED ALLOY

FIELD OF INVENTION

This invention relates to a method or press of forming a sintered article of powder metal having a high density and in particular relates to a process of forming a sintered article of powder metal by blending combinations of finely ground ferro alloys with elemental iron powder and other additives and then high temperature sintering of the article in a reducing atmosphere to produce sintered parts having a high density.

BACKGROUND OF THE INVENTION

Powder metal technology is well known to the persons skilled in the art and generally comprises the formation of metal powders which are compacted and then subjected to an elevated temperature so as to produce a sintered product.

Conventional sintering occurs at a maximum temperature of approximately up to 1,150° C. Historically the upper temperature has been limited to this temperature by sintering equipment availability. Therefore copper and nickel have traditionally been used as alloying additions when sintering has been conducted at conventional temperatures of up to 1,150° C., as their oxides are easily reduced at these temperatures in a generated atmosphere, of relatively high dew point containing CO, $CO_2$ and $H_2/N_2$. The use of copper and nickel as an alloying material is expensive. Moreover, copper when utilized in combination with carbon as an alloying material and sintered at high temperatures causes dimensional instability and accordingly the use of same in a high temperature sintering process results in a more difficult process to control the dimensional characteristics of the desired product.

Manufacturers of metal powders utilized in powder metal technology produce pre-alloyed steel powders which are generally more difficult to compact into complex shapes, particularly at higher densities (>7.0 g/cc). Manganese and chromium can be incorporated into pre-alloyed powders provided special manufacturing precautions are taken to minimize the oxygen content, for example, by oil atomization. Notwithstanding this, these powders still have poor compressabilities compared to admixed powders.

Conventional means to increase the strength of powder metal articles use up to 8% nickel, 4% copper and 1.5% molybdenum, in pre-alloyed, partially pre-alloyed, or admixed powders. Furthermore double press double sintering can be used for high performance parts as a means of increasing pan density. Conventional elements are expensive and relatively ineffective for generating mechanical properties equivalent to wrought steel products, which commonly use the more effective strengthening alloying elements manganese and chromium.

Moreover, conventional technology as disclosed in U.S. Pat. No. 2,402,120 teach pulverizing material such as mill scale to a very fine sized powder, and thereafter reducing the mill scale powder to iron powder without melting it.

Furthermore, U.S. Pat. No. 2,289,569 relates generally to powder metallurgy and more particularly to a low melting point alloy powder and to the usage of the low melting point alloy powders in the formation of sintered articles.

Yet another process is disclosed in U.S. Pat. No. 2,027,763 which relates to a process of making sintered hard metal and consists essentially of steps connected with the process in the production of hard metal. In particular, U.S. Pat. No. 2,027,763 relates to a process of making sintered hard metal which comprises producing a spray of dry, finely powdered mixture of fusible metals and a readily fusible auxiliary metal under high pressure producing a spray of adhesive agent customary for binding hard metals under high stress, and so directing the sprays that the spray of metallic powder and the spray of adhesive liquid will meet on their way to the molds, or within the latter, whereby the mold will become filled with a compact moist mass of metallic powder and finally completing the hard metallic particle thus formed by sintering.

U.S. Pat. No. 4,707,332 teaches a process for manufacturing structural parts from intermetallic phases capable of sintering by means of special additives which serve at the same time as sintering assists and increase the ductility of the finished structural product.

Moreover, U.S. Pat. No. 4,464,206 relates to a wrought powder metal process for pre-alloyed powder. In particular, U.S. Pat. No. 4,464,206 teaches a process comprising the steps of communinuting substantially non-compactable pre-alloyed metal powders so as to flatten the particles thereof heating the communinuted particles of metal powder at an elevated temperature, with the particles adhering and forming a mass during heating, crushing the mass of metal powder, compacting the crushed mass of metal powder, sintering the metal powder and hot working the metal powder into a wrought product.

Furthermore various processes have heretofore been designed in order to produce sintered articles having high densities. Such processes include a double press double sintering process as well as hot powder forging where virtually full densities of up to 7.8 g/cc may be obtained. However, such prior art processes are relatively expensive and time consuming.

Other methods to densify or increase the wear resistance of sintered iron based alloys are disclosed in U.S. Pat. 5,151,247 which relates to a method of densifying powder metallurgical parts while U.S. Pat. 4,885,133 relates to a process for producing wear-resistant sintered parts.

Historically steels have been produced with carbon contents of less than 0.8%. However ultrahigh carbon steels have been produced. Ultrahigh carbon steels are carbon steels containing between 0.8% to 2.0% carbon. The processes to produce ultra high carbon steels with fine spheroidized carbides are disclosed in U.S. Pat. 3,951,697 as well as in the article by D. R. Lesver, C. K. Syn, A. Goldberg, J. Wadsworth and O. D. Sherby, entitled "The Case for Ultra-high-Carbon Steels as Structural Materials" appearing in Journal of the Minerals, Metals and Materials Sot., August 1993.

The processes as described in the prior art present a relatively less cost effective process to achieve the desired mechanical properties of the sintered product.

It is an object of this invention to provide an improved process for producing sintered articles having improved dynamic strength characteristics and an accurate method to control same.

It is a further object of this invention to provide a process for producing sintered articles of densities greater than 7.3 g/cc by a single compaction, single sinter process.

It is a further object of this invention to provide an improved process for producing sintered articles having improved strength characteristics with ultrahigh carbon contents and an accurate method to control same.

The broadest aspect of this invention relates to a process of forming a sintered article using powder metal comprising blending carbon and ferro alloys and lubricant with compressible elemental iron powder, pressing said blended mixture to shape in a single compaction, sintering said article, and then high temperature sintering said article in a reducing atmosphere to produce a sintered article having a high density.

It is another aspect of this invention to provide a sintered powder metal having a composition of between 0.5% to 2.0% manganese, 0.5% to 5.0% molybdenum, 0.1% to 0.35% phosphorous, 0.02% to 0.1% boron, and 0.05% to 0.3% carbon with the remainder being iron and unavoidable impurities, with a sintered density greater than 7.3 g/cc.

It is yet another aspect of this invention to provide a powder metal composition comprising a blend of elemental iron powder, carbon, and ferro manganese, ferro molybdenum, ferro phosphorous, or ferro boron so as to result in an as sintered mass having between: 0.5% to 2.0% manganese; 0.5% to 5.0% molybdenum; 0.1% to 0.35% phosphorous; 0.05% to 0.3% carbon; 0.02% to 0.1% boron or $B_4C$; with the remainder being iron and unavoidable impurities.

It is a further aspect of this invention to provide a sintered powder metal article having a composition of between: silicon 0.5% to 1.0%; manganese 0.5% to 2.5 %; molybdenum 0% to 2.0%; chromium 0% to 2.0%; phosphorous 0% to 2.0%; carbon 0.8% to 2.0%; remainder being iron and unavoidable impurities and a sintered density of greater than 7.1 g/cc with high ductility.

Moreover it is another aspect of this invention to provide a powder metal composition comprising a blend of elemental iron powder, carbon and ferro silicon, ferro manganese, ferro molybdenum, ferro aluminium, ferro chromium, ferro phosphorous so as to result in an as sintered mass having between: silicon 0.5% to 1.0%; manganese 0.5% to 2.5%; molybdenum 0% to 2.0%; chromium 0% to 2.0%; phosphorous 0% to 0.5%; carbon 0.8% to 2.0%; remainder being iron and unavoidable impurities.

Another aspect of this invention relates to a process of manufacturing a sintered powder metal connecting rod comprising blending carbon and ferro alloys and lubricant with compressible elemental iron powder pressing said blended mixture to shape in a single compaction stage, single sintering said compacted connecting rod, and then high temperature sintering said connecting rod in a reducing atmosphere to produce a sintered powder metal connecting rod having a sintered density of greater than 7.3 g/cc.

Finally, another aspect of this invention relates to a sintered powder metal connecting rod having a density of greater than 7.3 g/cc and composition as follows:

DESCRIPTION OF THE DRAWINGS

These and other features and objections of the invention will now be described in relation to the following drawings.

DESCRIPTION OF THE INVENTION

Sintered Powder Metal Method

Figure 1:
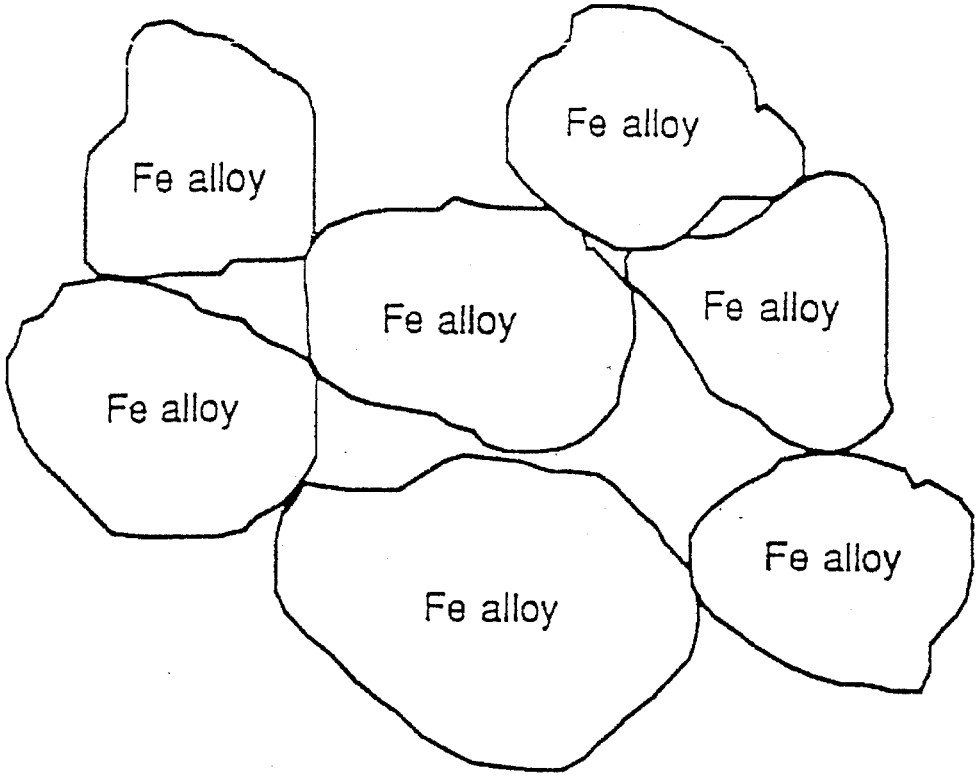
FIG. 1 is a drawing of the prior art mixture of iron alloy.

FIG. 1 is a representative view of a mixture of powder metal utilized in the prior art which consists of particles of ferro alloy in powder metal technology.

In particular, copper and nickel may be used as the alloying materials, particularly if the powder metal is subjected to conventional temperature of up to 1150° C. during the sintering process.

Moreover, other alloying materials such as manganese, chromium, and molybdenum which were alloyed with iron could be added by means of a master alloy although such elements were tied together in the prior art. For example a common master alloy consists of 22% of manganese, 22% of chromium and 22% of molybdenum, with the balance consisting of iron and carbon. The utilization of the elements in a tied form made it difficult to tailor the mechanical properties of the final sintered product for specific applications. Also the cost of the master alloy is very high and uneconomic.

By utilizing ferro alloys which consist of ferro manganese, or ferro chromium or ferro molybdenum or ferro vanadium, separately from one another rather than utilizing a ferro alloy which consists of a combination of iron, with manganese, chromium, molybdenum or vanadium tied together a more accurate control on the desired properties of the finished product may be accomplished so as to produce a method having more flexibility than accomplished by the prior art as well as being more cost effective.

Figure 2:
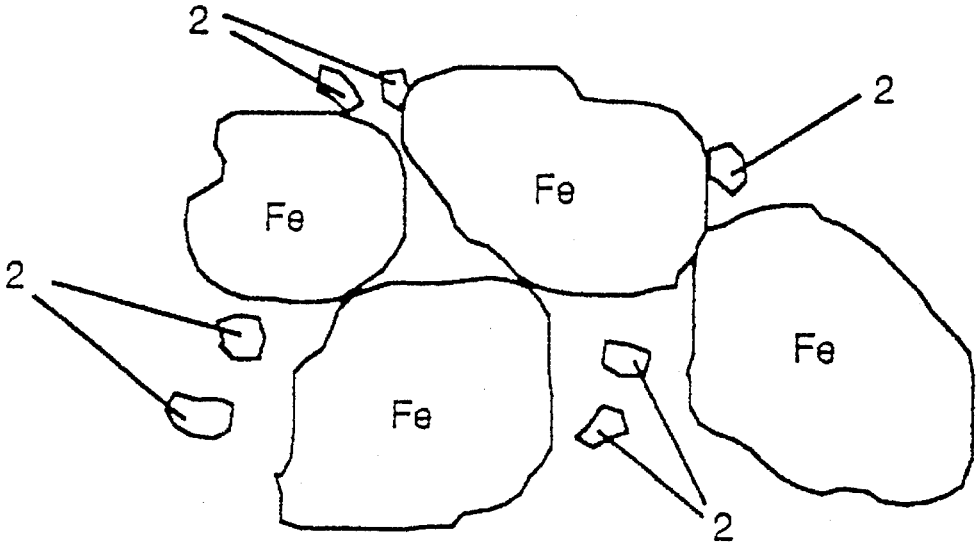
FIG. 2 is a drawing of a mixture of elemental iron, and ferro alloy in accordance with the invention described herein.

FIG. 2 is a representative drawing of the invention to be described herein, which consists of iron particles, Fe having a mixture of ferro alloys 2.

The ferro alloy 2 can be selected from the following groups:

| Name | Symbol | Approx. % of Alloy Element |
|---|---|---|
| ferro manganese | FeMn | 78% |
| ferro chromium | FeCr | 65% |
| ferro molybdenum | FeMo | 71% |
| ferro phosphorous | FeP | 18% |
| ferro silicon | FeSi | 75% |
| ferro boron | FeB | 17.5% |

The ferro alloys available in the market place may also contain carbon as well as unavoidable impurities which is well known to those people skilled in the art.

Chromium and molybdenum are added to increase the strength of the finished product particularly when the product is subjected to heat treatment after sintering. Moreover, manganese is added to increase the strength of the finished product, particularly if one is not heat treating the product after the sintering stage. The reason for this is manganese is a powerful ferrite strengthener (up to 4 times more effective than nickel).

Figure 3:
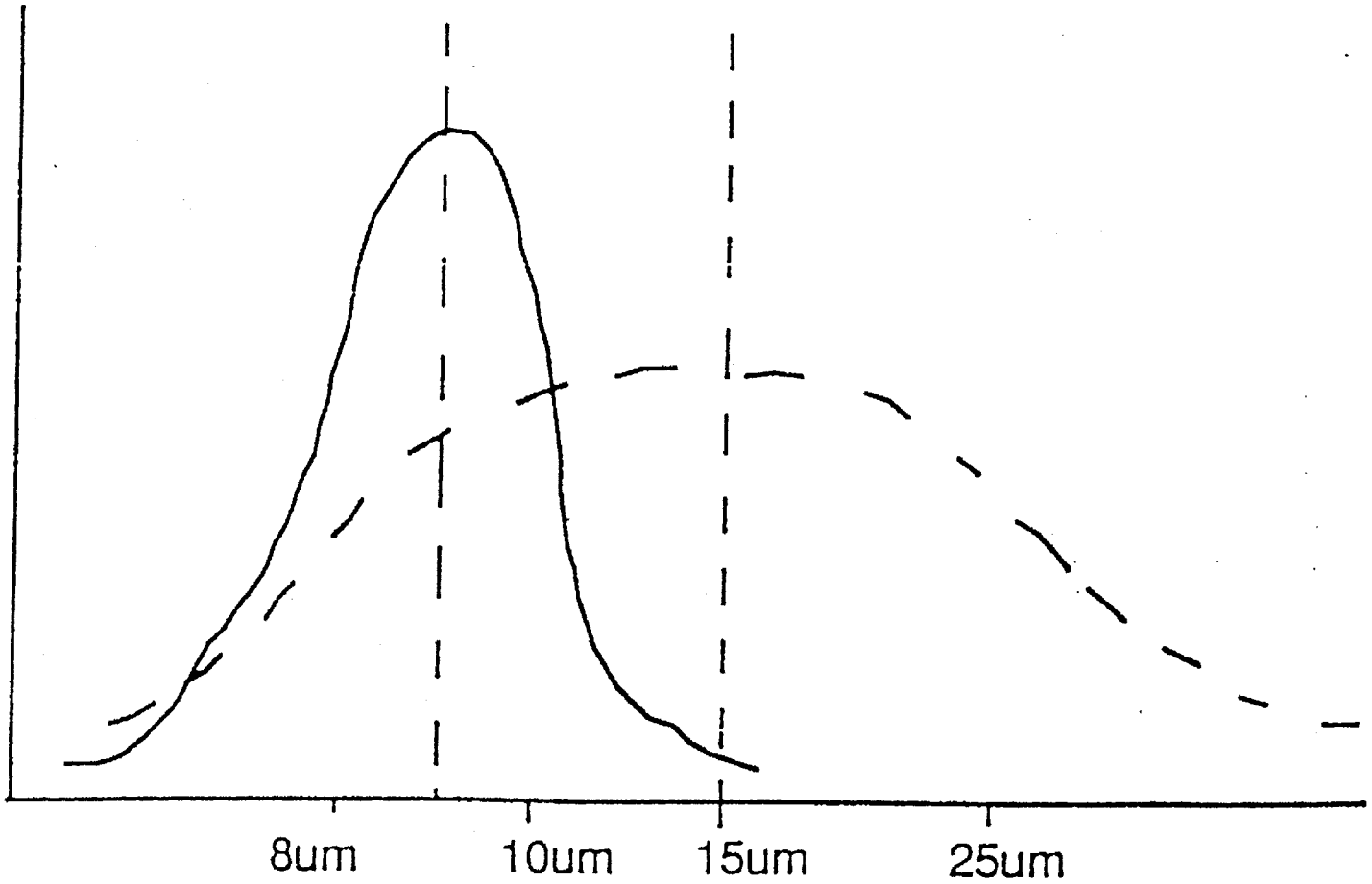
FIG. 3 is a graph showing the distribution of particle size in accordance with the invention herein.

Particularly good results are achieved in the method described herein by grinding the ferro alloys so as to have a $D_{50}$ or mean particle size of 8 to 12 microns and a $D_{100}$ of up to 25 microns where substantially all particles of the ferro alloys are less than 25 microns as shown in FIG. 3. For certain application a finer distribution may be desirable. For example a $D_{50}$ of 4 to 8 microns and a $D_{100}$ of 15 microns. In other applications to be described herein a $D_{90}$ of 30 microns may be utilized.

Many of the processes used in the prior art have previously used a $D_{50}$ of 15 microns as illustrated by the dotted lines of FIG. 3. It has been found that by finely grinding the of the ferro alloy to a fine particle size in an inert atmosphere as described herein a better balance of mechanical properties may be achieved having improved sintered pore morphology. In other words the porosity is smaller and more rounded and more evenly distributed throughout the mass which enhances strength characteristics of the finished product. In particular, powder metal products are produced which are much tougher than have been achieved heretofore.

The ferro alloy powders may be ground by a variety of means so long as the mean particle size is between 8 and 12 microns. For example, the ferro alloy powders may be ground in a ball mill, or an attritor, provided precautions are taken to prevent oxidation of the ground particles and to control the grinding to obtain the desired particle size distribution.

Figure 4:
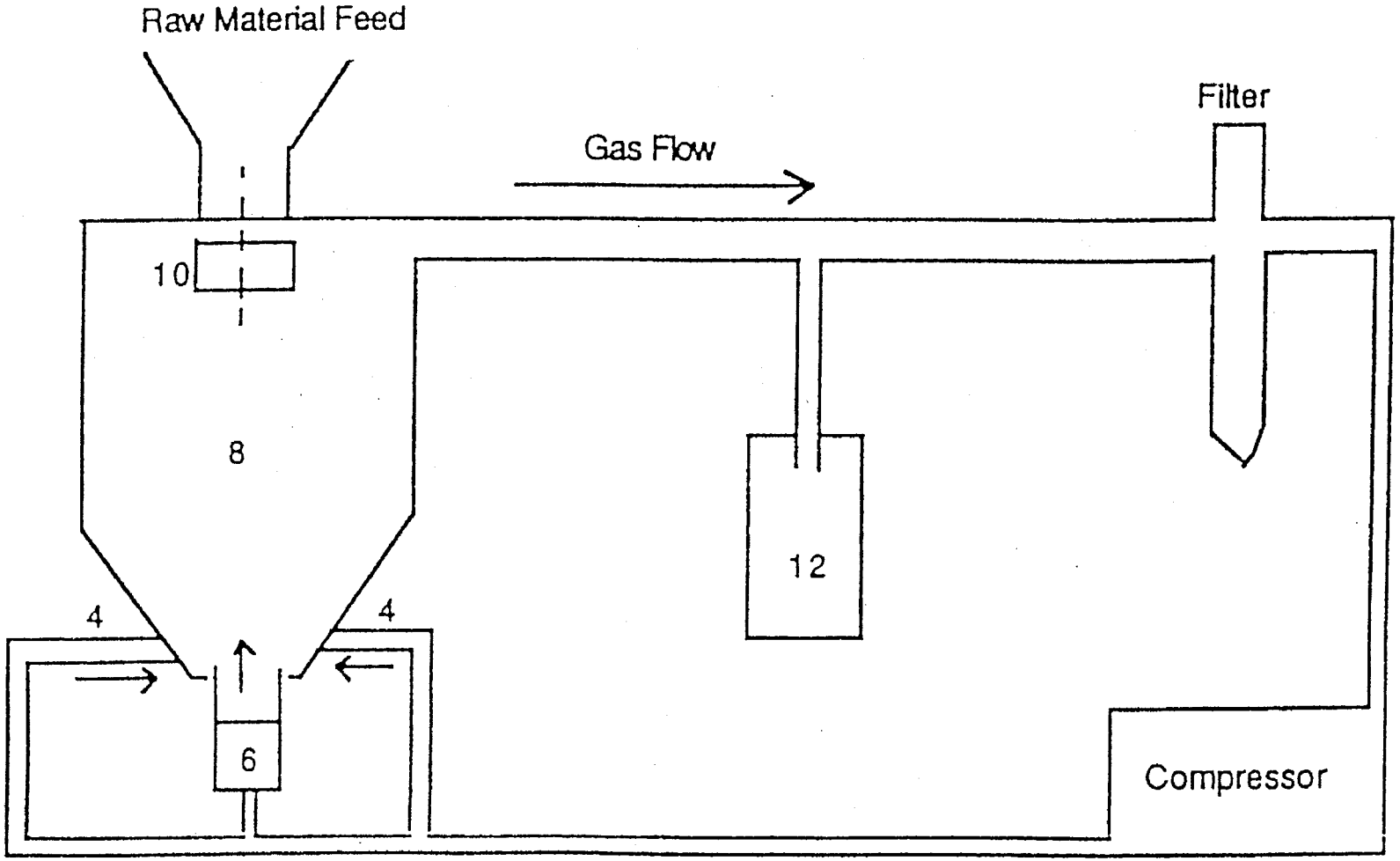
FIG. 4 is representative drawing of a jet mill utilized to produce the particle size of the ferro alloy.

Particularly good results in controlling the particle size as described herein are achieved by utilizing the jet mill illustrated in FIG. 4. In particular, an inert gas such as cyclohexane, nitrogen or argon is introduced into the grinding chamber via nozzles 4 which fluidize and impart high energy to the particles of ferro alloys 6 upward and causes the ferro alloy particles to break up against each other. As the ferro alloy particles grind up against each other and reduce in size they are lifted higher up the chamber by the gas flow and into a classifier wheel 10 which is set at a particular RPM. The particles of ferro alloy enter the classifier wheel 10 where the ferro alloy particles which are too big are returned into the chamber 8 for further grinding while particles which are small enough namely those particles of ferro alloy having a particle size of less than 25 microns pass through the wheel 10 and collect in the collecting zone 12. The grinding of the ferro alloy material is conducted in an inert gas atmosphere as described above in order to prevent oxidization of the ferro alloy material. Accordingly, the grinding mill shown in FIG. 4 is a totally enclosed system. The jet mill which is utilized accurately controls the size of the particles which are ground and produces a distribution of ground particles which are narrowly centralized as shown in FIG. 3. The classifier wheel speed is set to obtain a $D_{50}$ of 8 to 10 microns. The speed will vary with different ferro alloys being ground.

The mechanical properties of a produced powder metal product may be accurately controlled by:

(a) selecting elemental iron powder;

(b) determining the desired properties of the sintered article and selecting:

(i) a quantity of carbon; and (ii) the ferro alloy(s) and selecting the quantity of same;

(c) grinding separately the ferro alloy(s) to a mean particle size of approximately 8 to 12 microns, which grinding may take place in a jet mill as described herein;

(d) introducing a lubricant while blending the carbon and ferro alloy(s) with the elemental iron powder;

(e) pressing the mixture to form the article; and (f) subjecting the article to a high temperature sintering at a temperature of between 1,250° C. and 1,350° C. in a reducing atmosphere.

The lubricant is added in a manner well known to those persons skilled in the art so as to assist in the binding of the powder as well as assisting in the ejecting of the product after pressing. The article is formed by pressing the mixture into shape by utilizing the appropriate pressure of, for example, 25 to 50 tonnes per square inch.

The invention disclosed herein utilizes high temperature sintering of 1,250° C. to 1,380° C. and a reducing atmosphere of, for example hydrogen or in vacuum. Moreover, the reducing atmosphere in combination with the high sintering temperature reduces or cleans off the surface oxides allowing the particles to form good bonds and the compacted article to develop the appropriate strength. A higher temperature is utilized in order to create the low dew point necessary to reduce the oxides of manganese and chromium which are difficult to reduce. The conventional practice of sintering at 1150° C. does not create a sintering regime with the right combination of low enough dew point and high enough temperature to reduce the oxides of chromium, manganese, vanadium and silicon.

Secondary operations such as machining or the like may be introduced after the sintering stage. Moreover, heat treating stages may be introduced after the sintering stage. Advantages have been realized by utilizing the invention as described herein. For example, manganese, chromium and molybdenum ferro alloys are utilized to strengthen the iron which in combination or singly are less expensive than the copper and nickel alloys which have heretofore been used in the prior art. Moreover, manganese appears to be four times more effective in strengthening iron than nickel as 1% of manganese is approximately equivalent to 4% nickel, and accordingly a cost advantage has been realized.

Furthermore sintered steels with molybdenum, chromium, and manganese are dimensionally more stable during sintering at high temperatures described herein than are iron-copper-carbon steels (ie. conventional powder metal (P/M) steels). Process control is therefore easier and more cost effective than with conventional P/M alloys.

Furthermore, the microstructure of the finished product are improved as they exhibit:

(a) well rounded pores;

(b) a homogenous structure;

(c) structure having a much smaller grain size; and a product that is more similar to wrought and east steels in composition than conventional powder metal steels.

The process described herein allows one to control or tailor the materials which are desired for a particular application. Applicant has in PCT application PCT/CA92/00388 filed 9 Sep. 1992 described and claimed a process and range of compositions to produce powder metals having the following grades:

(1) sinter hardening grades (2) gas quenched grades (3) as sintered grades (4) high strength grades (5) high ductility grades Hi-Density Sintered Alloy The method described herein can be adapted to produce a high-density grade having the following composition:

Mn: 0.5%–2.0%

Mo: 0.5–5.0%

P: 0.1–0.35%

Boron or $B_4C$ : 0.02–0.1%

C: 0.05–0.3%

Figure 8:
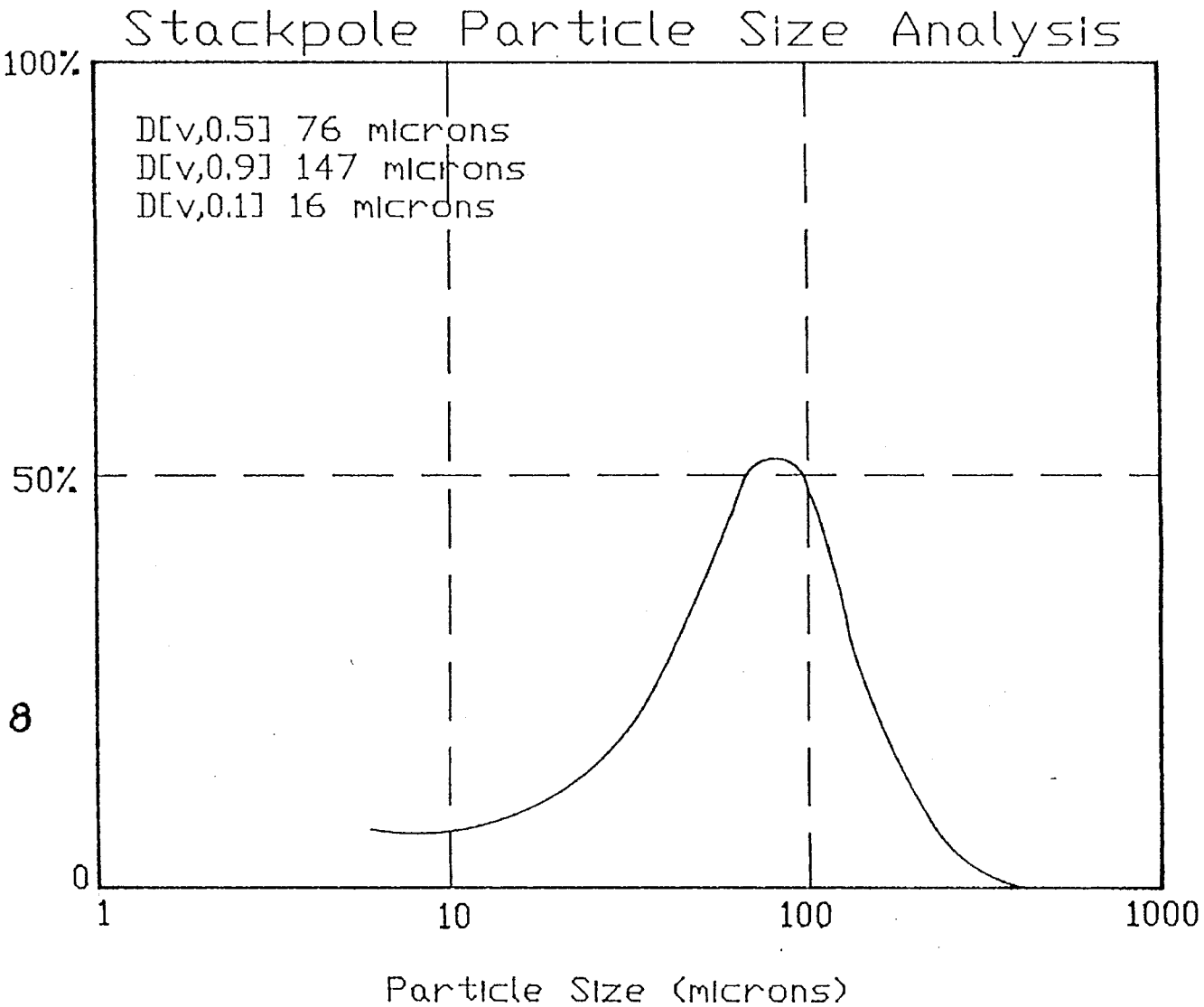
FIG. 8 is a graph showing base iron powder distribution.

Particularly good results have been observed by utilizing ferro manganese and ferro molybdenum produced in the jet mill referred to above. In particular, good results have been obtained by utilizing a particle size for ferro manganese with a $D_{50}$ of 10 microns and $D_{90}$ of 30 microns. Moreover, particularly good results have been obtained by using a mean particle size of $D_{50}$ of 10 microns and a $D_{90}$ of 30 microns for the ferro molybdenum. The ferro phosphorous may be purchased or produced in the jet mill having a $D_{50}$ of 8 microns and $D_{100}$ of 25 microns. The ferro manganese, ferro molybdenum, ferro phosphorous and ferro boron are selected and admixed with the base iron powder so as to produce a sintered article having a composition referred to above under the heading "Hi-Density Sintered Alloy". Such ferro alloys are admixed with the base iron powder of a particular particle size distribution as shown in FIG. 8. In particular FIG. 8 illustrates that the base iron powder has a $D_{50}$ of 76 microns, $D_{90}$ of 147 microns and $D_{10}$ of 16 microns.

The ferro alloys referred to above admixed with the base iron powder is then compacted by conventional pressing methods to a minimum of 6.5 g/cc. Sintering then occurs in a vacuum, or in a vacuum under partial backfill (ie. bleed in argon or nitrogen), or pure hydrogen, or a mixture of $H_2/N_2$ at a temperature of 1300° C. to 1380° C. The vacuum typically occurs at approximately 200 microns. Moreover, the single step compaction typically occurs preferably between 6.5 g/cc to 6.8 g/cc.

It has been found that by utilizing the composition referred to above, hi-density as sintered articles greater than 7.3 g/cc can be produced in a single compression rather than by a double pressing, double sintering process. By utilizing the invention disclosed herein hi-density sintered articles can be produced having a sintered density of 7.3 g/cc to 7.6 g/cc.

Figure 5:
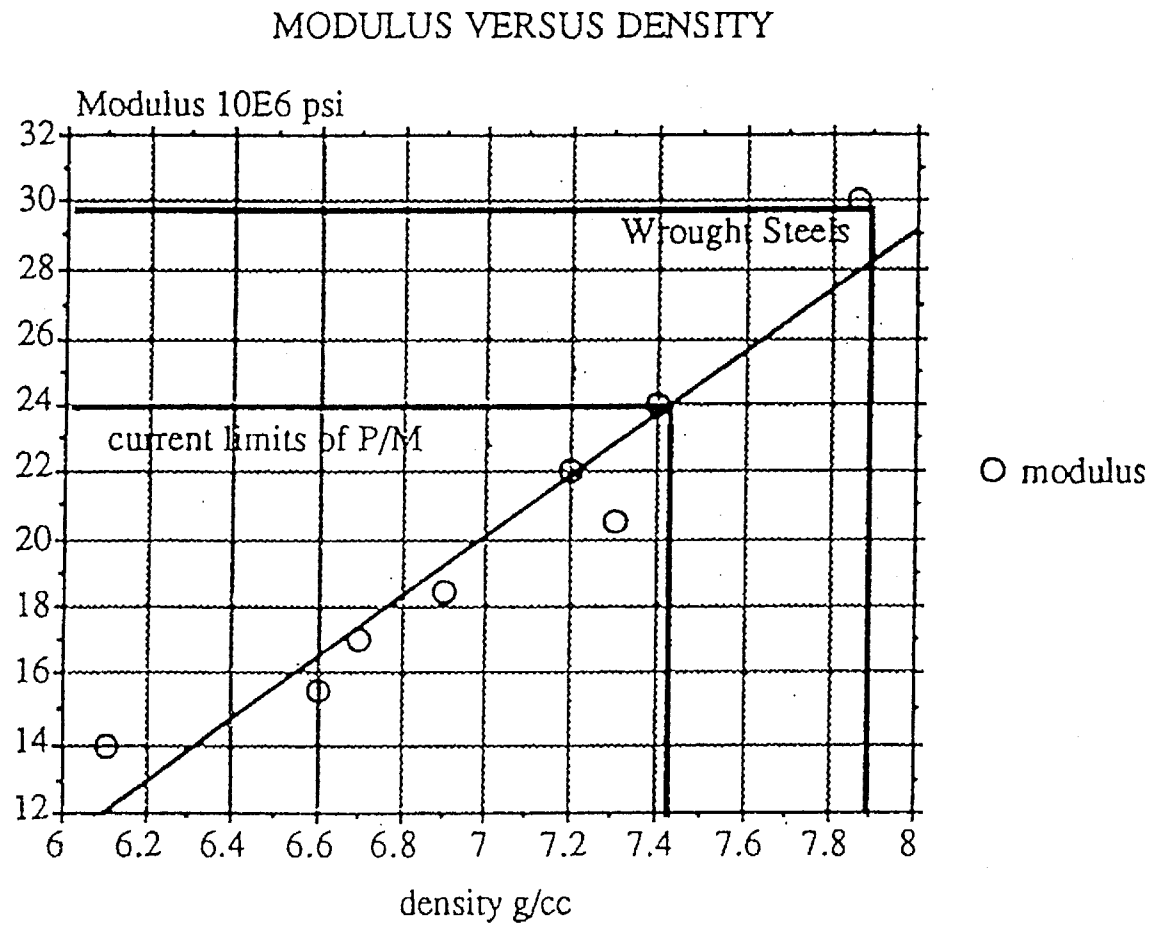
FIG. 5 is a modulus to density graph.

Such hi-density sintered articles may be used for articles requiring the following characteristics, namely:

high modulus high performance high tensile properties high fatigue high apparent hardness FIG. 5 shows the relationship between the density of a sintered article and the modulus. It is apparent from FIG. 5 that the higher the density the higher the modulus.

It should be noted that tensile strengths of approximately 80–100 ksi as well as impact strengths of approximately 100 foot pounds have been achieved by using the high density sintered alloy method described herein.

Ultrahigh Carbon Steel

Typically the percentage of carbon steel lies in the range of up to 0.8% carbon. Ultrahigh carbon steels are carbon steels containing between 0.8% to 2% carbon.

Figure 6:
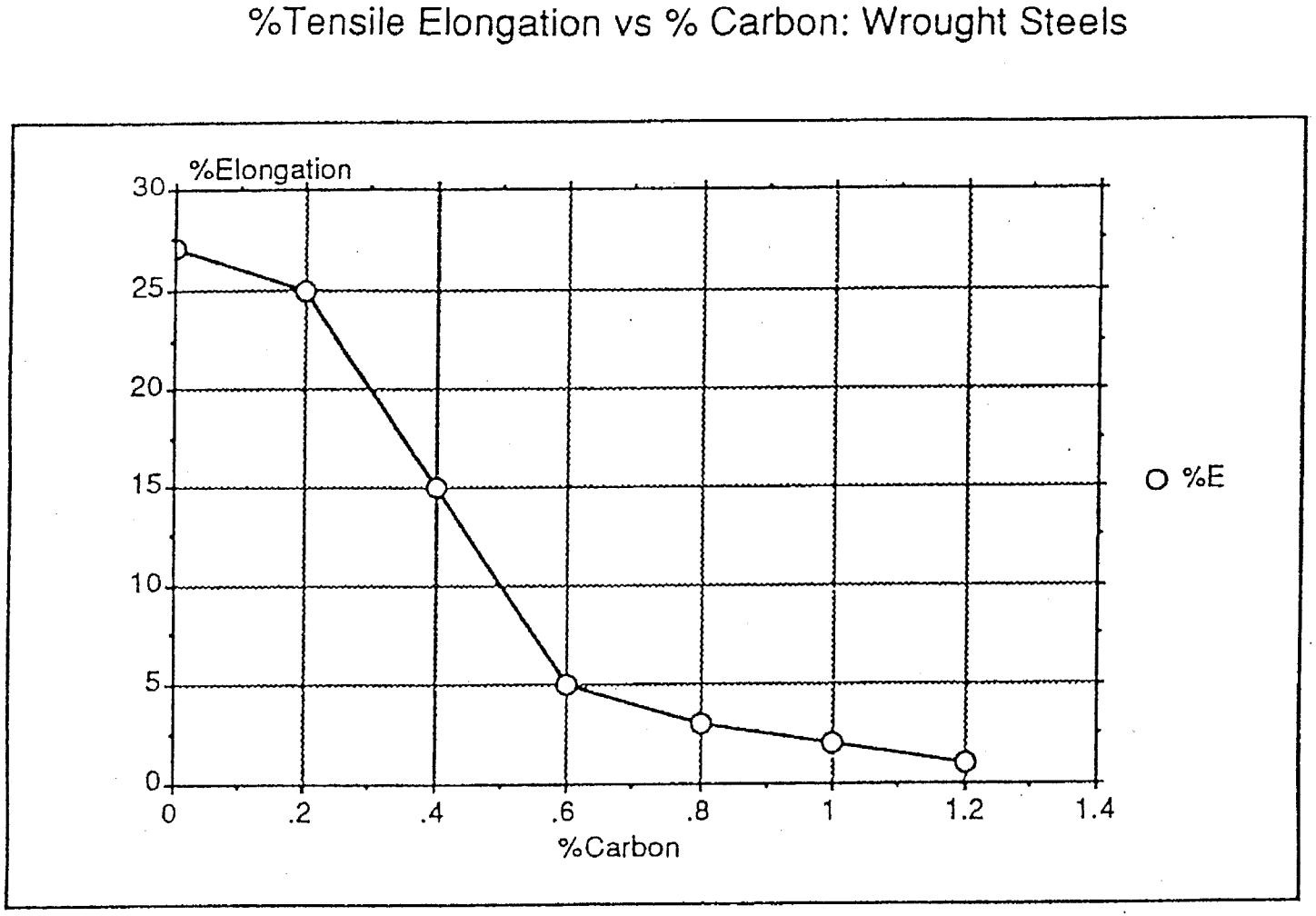
FIG. 6 is an elongation to percent carbon graph.

It is known that tensile ductility decreases dramatically with an increase in carbon content and accordingly ultrahigh carbon steels have historically been considered too brittle to be widely utilized. FIG. 6 shows the relationship between elongation or ductility versus the carbon content of steels. It is apparent from FIG. 6 that the higher the percentage of carbon, the less ductile the steel. Moreover, by reducing the carbon in steels, this also reduces its tensile strength.

However, by using the appropriate heat treatments for ultrahigh carbon steels, high ductilities as well as high strengths may be obtained.

Ultrahigh Carbon Steel Powder Metals with Hi-Density Sintered Alloys

The method described herein may be adapted to produce a high density grade powder metal having an ultrahigh carbon content with the following composition:

Si 0.5–1.0%

Mn 0.5–2.5%

Mo 0–2.0%

Cr 0–2.0%

P 0–0.5%

C 0.8 to 2.0%

By adding the ferro alloys referred to above, namely ferro silicon, ferro magnesium, ferro molybdenum, ferro chromium, and ferro phosphorous with 0.8% to 2.0% carbon to the base powder iron and sintering same in a vacuum or vacuum with backfill, or pure hydrogen at a temperature of 1280° C. to 1380° C., a high density sintered alloy can be produced via supersolidus sintering. With respect to the composition referred to above, an alloy having a sintered density of 7.7 g/cc may be produced by single stage compaction and sintering at 1315° C. under vacuum, or in a reducing atmosphere containing $H_2/N_2$.

It should be noted that iron has a ferrite and austenite phase. Moreover, up to 0.8% carbon can be dissolved in ferrite or (alpha) phase, and up to 2.0% in the austenite or (gamma) phase. The transition temperature between the ferrite and austenite phase is approximately 727° C.

Heat Treatment—Spheroidization

Figure 7:
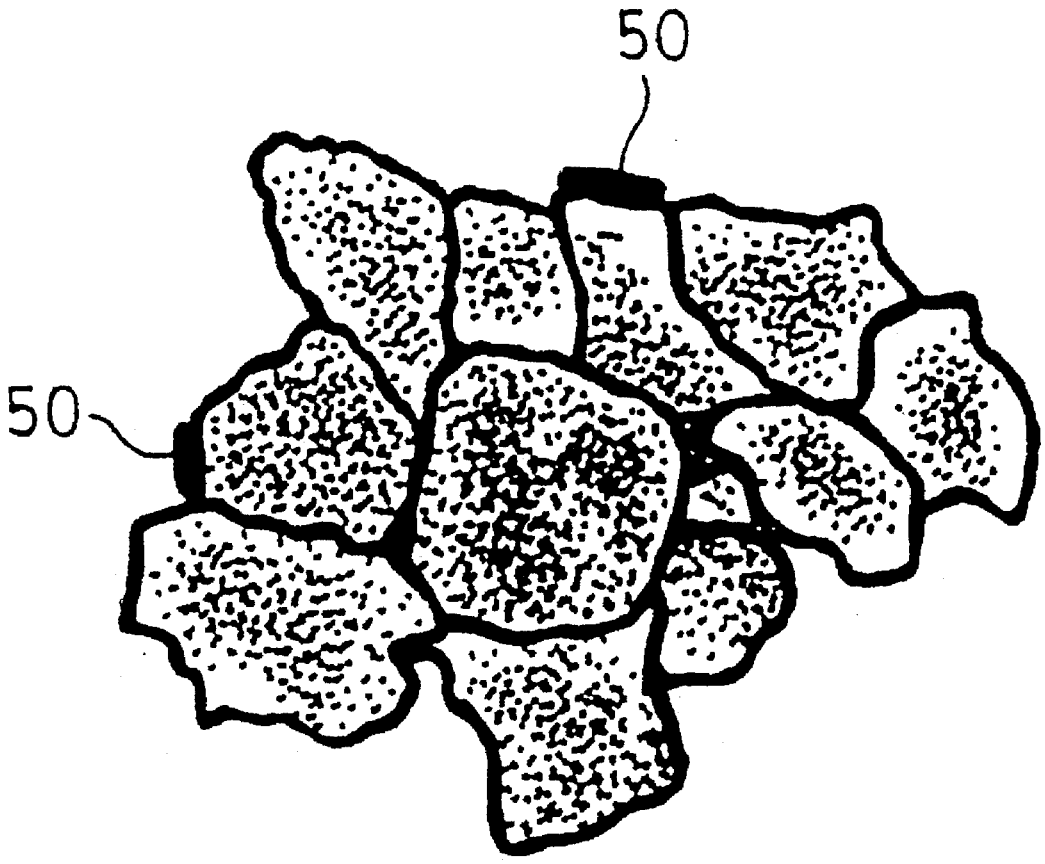
FIG. 7 is a sketch of grain boundary carbides in an as sintered article.

The sintered ultrahigh carbon steel article produced in accordance with the method described herein exhibits a hi-density although the article will tend to be brittle for the reasons described above. In particular, the brittleness occurs due to the grain boundary carbides 50, which are formed as shown in FIG. 7. The grain boundary carbides 50 will precipitate during the austenite to ferrite transformation during cooling. Spheroidizing is any process of heating or cooling steel that produces a rounded or globular form of carbide.

Spheroidization is the process of heat treatment that changes embrittling grain boundary carbides and other angular carbides into a rounded or globular form. In prior art, the spheroidization process is time consuming and uneconomical as the carbides transform to a rounded form only very slowly. Typically, full spheroidization required long soak times at temperature. One method to speed the process is to use thermomechanical treatments, which combines mechanical working and heat to cause more rapid spheroidization. This process is not suited to high precision, net shape parts and also has cost disadvantages.

Figure 9:
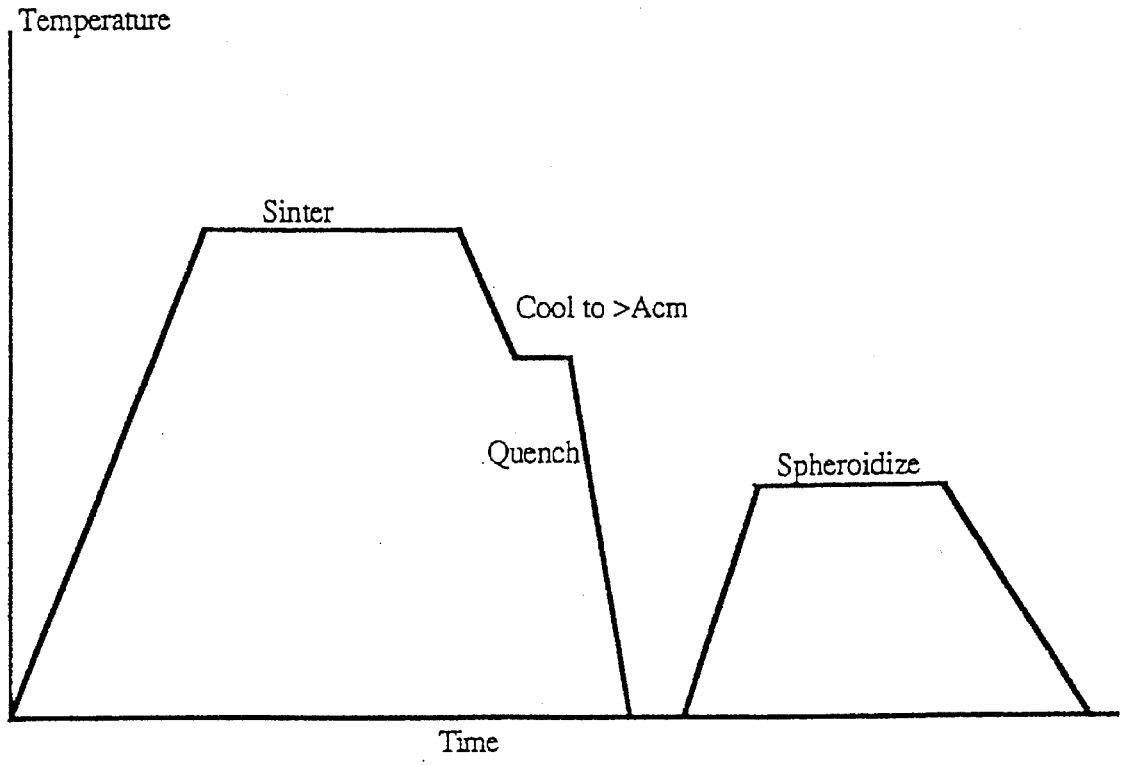
FIG. 9 is a schematic diagram of the high density powder metal process stages.
Figure 10:
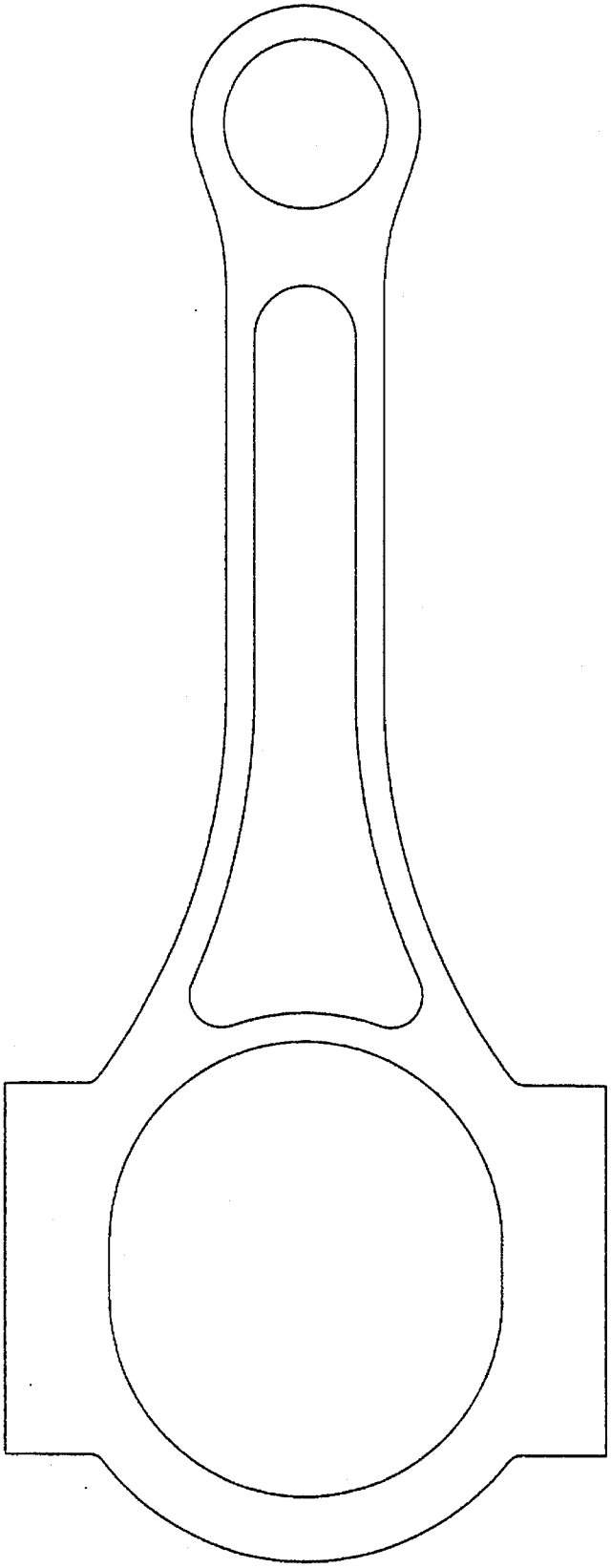
FIG. 10 is a top plan view of a connecting rod made in accordance with the invention described herein.

A method for spheroidization has been developed for high density sintered components whereby the parts are sintered, cooled within the sinter furnace to above the $A_{CM}$ temperature, and rapidly quenched to below 100° C., so that the precipitation of embrittling grain boundary carbides is prevented or minimised. This process results in the formation of a metastable microstructure consisting largely of retained austenite and martensite. A subsequent heat treatment whereby the part is raised to a temperature below the $A_1$ temperature (approximately 650° C.) results in relatively rapid spheroidization of carbides, and high strength and ductility. FIG. 9 is a graph which illustrates this method for spheroidization.

Accordingly, by spheroidizing the as sintered ultrahigh carbon steel, such process gives rise to a powder metal having high ductility, typically 5–10% tensile elongation and high strength of 100–120 ksi UTS. The spheroidizing treatment dissolves the grain boundary carbides into the austenite grains.

The powder metal ultrahigh carbon steel that has been spheroidized, gives rise to a hi-density P/M steel having a good balance of properties with high strength and ductility.

Such sintered parts may be used in the spheroidized condition or further heat treated for very high strength components.

Moreover, the ultrahigh carbon steel powder metal may also be conventionally heat treated after spheroidization, but without redissolving the spheroidized carbides, for very high strength and durability, such as:

1. austentize matrix;
2. quench to martensite;
3. temper martensite

Such sintered pan may be used in the spheroidized condition or heat treated for high strength.

Connecting Rods

Various sintered articles can be made in accordance with the invention described herein. One particularly good application of the invention described herein relates to the manufacture of automobile engine connecting rods or con rods.

Although the sintered connecting rods have heretofore been manufactured in the prior art as particularized in the article entitled "Fatigue Design of Sintered Connecting Rods" appearing in Journal of the Minerals, Metals and Materials Soc., May 1988, such prior art sintered connecting rods have not been able to attain the strength characteristics as well as the efficiencies described herein.

In particular, hi-density sintered alloy connecting rods can be produced in accordance with the hi-density sintered alloy method described herein, as well as the ultra-high carbon steel as described herein.

More particularly, automobile connecting rods can be manufactured having the following compositions:

Mn 0.5% to 1.0%

C 1.2% to 1.8%

Fe balance

Such automobile connecting rods have exhibited the following characteristics, namely:

As Spheroidized:

UTS (ultimate tensile stress) 120 ksi

YS (yield) 95 ksi

% Elongation 8%

Impact Strength 40 ft/lbs.

References to percentages herein refer to percent by weight.

Other products such as high stressed transmission gears can also be made in accordance with the invention described herein.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A process of forming a sintered article of powder metal comprising:

(a) blending
  i. carbon
  ii. separate ferro alloy particles of ferro manganese, ferro molybdenum, ferro phosphorous and ferro boron or boron carbide,
  iii. lubricant with
  iv. compressible iron powder, (b) pressing said blended mixture to shape in a single compaction stage (c) and then high temperature sintering said article at a temperature of at least 1300° C. in a reducing atmosphere to produce a sintered article having a sintered density of greater than 7.3 g/cc.

2. A process as claim in claim 1 wherein said iron powder has a mean particle size of approximately 76 micron, and substantially 10% of said iron powder is less than 16 microns and substantially 90% of said iron powder is less than 147 microns.

3. A process as claimed in claim 1 wherein said separate ferro alloy particles are blended with ferro alloy particles so as to control the desired properties of the sintered article.

4. A process as claimed in claim 1 wherein said ferro manganese and said ferro molybdenum have a mean particle size of approximately 10 microns and substantially 90% of said ferro manganese and ferro molybdenum have a particle size of less than 30 microns.

5. A process as claimed in claim 4 wherein said reducing atmosphere is either hydrogen, a vacuum or vacuum under partial backfill.

6. A process as claimed in claim 4 wherein said ferro phosphorous has a mean particle size of approximately 8 microns and substantially 100% of said ferro phosphorous has a particle size of less than 25 microns said sintering is conducted at a temperature betweem 1300° C. and 1380° C. in a single sinter process.

7. A process as claimed in claim 6 wherein said ferro manganese and ferro molybdenum are ground in a jet mill.

8. A process as claimed in claim 7 wherein said sintered article has a composition of between 0.5% to 2.0% manganese, 0.5% to 5.0% molybdenum, 0.1% to 0.35% phosphorous. 0.05% to 0.3% carbon, and 0.02% to 0.1% boron.

9. A process as claimed in claim 8 wherein said blended mixture is pressed to a density of approximately 6.5 g/cc prior to sintering.

10. A process of forming a sintered article of powder metal comprising:

a. blending
  i. carbon
  ii. separate ferro alloy particles of ferro silicon, ferro manganese, ferro molybdenum, ferro aluminum, ferro chromium and ferro phosphorous
  iii. lubricant with
  iv. compressible iron powder, b. pressing said blended mixture to shape in a single compaction stage c. and then high temperature sintering said article, at a temperature of at least 1280° C. in a reducing atmosphere to produce a sintered article having a sintered density of greater than 7.3 g/cc.

11. A process as claimed in claim 10 wherein said sintered article has a composition between 0.8% to 2.0% carbon.

12. A process as claimed in claim 11 wherein said sintered article includes austenite grains and grain boundary carbides between said austenite grains and wherein said sintered article is heat treated after said sintering so as to spheroidize said carbides and produce a sintered metal article having 5 to 10 percent tensile elongation.

13. A process as claimed in claim 11 further including:

a. cooling said sintered article within a sintering furnace to just above the transition temperature between the austenite and the austenite plus iron carbide phase;

b. rapidly quenching said sintered article to below 100°;

c. then raising the temperature to the transition temperature between the ferrite and austenite phases so as to rapidly spheroidize said carbides.

14. A process as claimed in claim 13 wherein said sintered article of powder metal contains by weight from 0.5% to 1.0% silicon from 0.5% to 2.5% manganese from 0% to 2.0% molybdenum from 0% to 2.0% chromium from 0% to 0.5% phosphorous from 0.8% to 2.0% carbon the balance essentially iron and unavoidable impurities.

15. A process as claimed in claim 14 wherein said sintering occurs at a temperature between 1290° C. to 1380° C.

16. A process as claimed in claim 15 wherein said sintered article has a sintered density of 7.7 g/cc.

17. A process of manufacturing a sintered powder metal connecting rod comprising:

a. blending i. carbon ii. separate ferro alloy particles of ferro manganese, ferro molybdenum, ferro phosphorous and ferro boron or boron carbide, iii. lubricant with iv. compressible iron powder, b. pressing said blended mixture to shape in a single compaction stage c. and then high temperature sintering said connecting rod at a temperature of at least 1300° C. in a reducing atmosphere to produce a sintered powder metal connecting rod having a sintered density of greater than 7.3 g/cc.

* * * * *